United States Patent [19]

Marco et al.

[11] Patent Number: 5,018,620

[45] Date of Patent: May 28, 1991

[54] CARRIER STOCK WITH BAND SEGMENTS EXTENDING BETWEEN OPPOSITE EDGES

[75] Inventors: Leslie S. Marco, Bloomingdale; Mindaugas J. Klygis, Barrington; William N. Weaver, Northbrook, all of Ill.

[73] Assignee: Illinois Tool Works Inc., Glenview, Ill.

[21] Appl. No.: 519,859

[22] Filed: May 7, 1990

[51] Int. Cl.[5] ..... B65D 75/00; B65D 71/00

[52] U.S. Cl. ..... 206/150; 206/199; 206/428; 294/87.2

[58] Field of Search ..... 206/150, 158, 427, 428, 206/199, 162, 139; 294/87.2

[56] References Cited

U.S. PATENT DOCUMENTS

| | | | |
|---|---|---|---|
| 3,792,562 | 2/1974 | Gilliam | 206/428 |
| 4,018,331 | 4/1977 | Klygis | 206/199 |
| 4,033,457 | 7/1977 | Weaver | 294/87.2 |
| 4,219,117 | 8/1980 | Weaver et al. | 206/150 |
| 4,356,914 | 11/1982 | Olsen et al. | 206/150 |
| 4,548,317 | 10/1985 | Weaver | 294/87.2 |
| 4,557,375 | 12/1985 | Weaver et al. | 294/87.2 |

*Primary Examiner*—William I. Price

*Attorney, Agent, or Firm*—Dressler, Goldsmith, Shore, Sutker & Milnamow, Ltd.

[57] ABSTRACT

Carrier stock formed from a single sheet of resilient polymeric material, such as low density polyethylene, for machine application to substantially identical containers. The stock is severable, along transverse lines that are perforated, to form individual carriers with container-receiving apertures and additional apertures, as defined by band segments, and with integral handles. The additional apertures facilitate reconfiguration of the stock from an as-formed configuration to an application configuration. Band segments defining the container-receiving apertures at each end rank at each end rank at each edge row includes an outer cross segment, an outer edge segment, an inner cross segment, and an inner oblique segment. The inner cross segment extends from the outer edge segment to the margin of one of the additional apertures. The inner oblique segment, which is slit to define a folding line, extends from the outer cross segment to the margin of the same one of the additional apertures in a generally oblique direction tending away from the outer edge segment when such stock is unstressed. The handle has bifurcated ends with one foot joined to an outer edge segment and another foot joined to an adjoining segment.

19 Claims, 2 Drawing Sheets

CARRIER STOCK WITH BAND SEGMENTS EXTENDING BETWEEN OPPOSITE EDGES

TECHNICAL FIELD OF THE INVENTION

This invention pertains to carrier stock for machine application to substantially identical cans or other containers. This invention pertains, more particularly, to carrier stock that is severable along band segments extending between opposite edges of such stock to form individual carriers, which may have integral handles.

BACKGROUND OF THE INVENTION

Typically, carrier stock with individual container-receiving apertures for machine application to substantially identical containers is formed, as by die-cutting, from a single sheet of resilient polymeric material, such as low density polyethylene.

An example of such stock for machine application to substantially identical containers in three longitudinal rows of indeterminate length is disclosed in Klygis U.S. Pat. No. 4,018,331. As disclosed therein, such stock may be transversely severed, after it has been applied to such containers, to produce packages with three containers, six containers, or other multiples of three containers. A suitable machine for applying such stock is disclosed in Benno et al. U.S. Pat. No. 3,959,949.

An example of such stock for machine application to substantially identical containers in two longitudinal rows of indeterminate length is disclosed in Weaver et al. U.S. Pat. No. 4,219,117. Another example is disclosed in Olsen et al. U.S. Pat. No. 4,356,914, in which such stock is asymmetrical, so as to be particularly useful in machine applications utilizing nonsymmetrical application forces. It is disclosed in each of these patents that such stock may be transversely severed to form individual carriers. A suitable machine for applying such stock is disclosed in Braun U.S. Pat. No. 4,250,682.

Typically, such stock is formed with band segments, which define separate apertures to receive the individual containers. Moreover, the band segments define additional apertures, which eliminate excess material from such stock, and which may serve also as finger apertures. When such stock is applied, transverse forces are applied, whereby at least some of the band segments are stretched. Furthermore, such stock is reconfigured from an as-formed configuration to an application configuration, in which such stock is applied to such containers. The additional apertures tend to be transversely elongated so as to facilitate reconfiguration of such stock.

As exemplified in the Klygis, Weaver et al., and Olsen et al. patents and unlike what is contemplated by this invention, the carrier stock is severed transversely along band segments that do not extend completely between opposite edges of such stock. Specifically, such stock is severed transversely along band segments that are interrupted by such additional apertures.

SUMMARY OF THE INVENTION

This invention provides carrier stock formed from a single sheet of resilient polymeric material, such as low density polyethylene, for machine application to substantially identical containers. Such stock is severable to form individual carriers. Each individual carrier has separate apertures to receive the individual containers. Each individual carrier has at least one additional aperture, which facilitates reconfiguration of such stock from an as-formed configuration to an application configuration.

The carrier stock is formed with band segments defining the carrier-receiving and additional apertures. Each of these apertures has a margin comprising certain of the band segments. The container-receiving apertures are in longitudinal rows and in transverse ranks. Such rows include edge rows at opposite edges of such stock. Such ranks include end ranks at each end of each individual carrier.

The container-receiving aperture of each end rank at each edge row, i.e., the container-receiving aperture at each corner of each individual carrier, is defined by band segments including an outer cross segment, an outer edge segment, an inner cross segment, and an inner oblique segment. The inner oblique segment is characteristic of this invention.

The carrier stock is severable along the outer cross segment. The outer cross segment extends completely across such stock, between the opposite edges of such stock. The outer cross segment extends therebetween in a generally transverse direction when such stock is unstressed. Preferably, the outer cross segment is formed with a weakened line, such as a perforated line, which facilitates severance of such stock to form the individual carriers.

The outer edge segment extends along one of the opposite edges of the carrier stock. The outer edge segment extends therealong in a generally longitudinal direction when such stock is unstressed. The inner cross segment extends from the outer edge segment to the margin of one of the additional apertures. The inner cross segment extends therefrom in a generally transverse direction when such stock is unstressed.

The inner oblique segment extends from the outer cross segment to the margin of the same one of the additional apertures. The inner oblique segment extends therefrom in a generally oblique direction tending away from the outer edge segment when the carrier stock is unstressed. The inner oblique segment facilitates reconfiguration of such stock from the as-formed configuration to an acceptable application configuration due to stretch-inhibiting characteristics of the end panels. It is preferred that the inner oblique segment and minor longitudinal sections are slit to define a folding line extending in the generally longitudinal direction when the carrier stock is applied to containers.

In a preferred arrangement, each transverse rank has three or more container-receiving apertures. Also, each container-receiving aperture in each end row, except for the container-receiving apertures in the end ranks, is defined partly by a band segment that extends in a generally longitudinal direction when such stock is unstressed.

The carrier stock may be also formed with an integral handle for each individual carrier. The handle has two opposite ends and is joined at its opposite ends to certain of the band segments, at one edge of such stock.

Preferably, each end of the handle is joined to one of the outer edge segments. Each end of the handle may be also joined to an adjoining one of the band segments. Each end of the handle may be bifurcated to form two feet, namely one foot joined to one of the outer edge segments and another foot joined to an adjoining one of the band segments. Thus, stresses from each end of the handle are distributed to multiple band segments, at the same edge of said stock.

These and other objects, features, and advantages of this invention are evident from the following description of a preferred embodiment of the invention with reference to the accompanying drawings.

DETAILED DESCRIPTION OF PREFERRED EMBODIMENT

Figure 1:
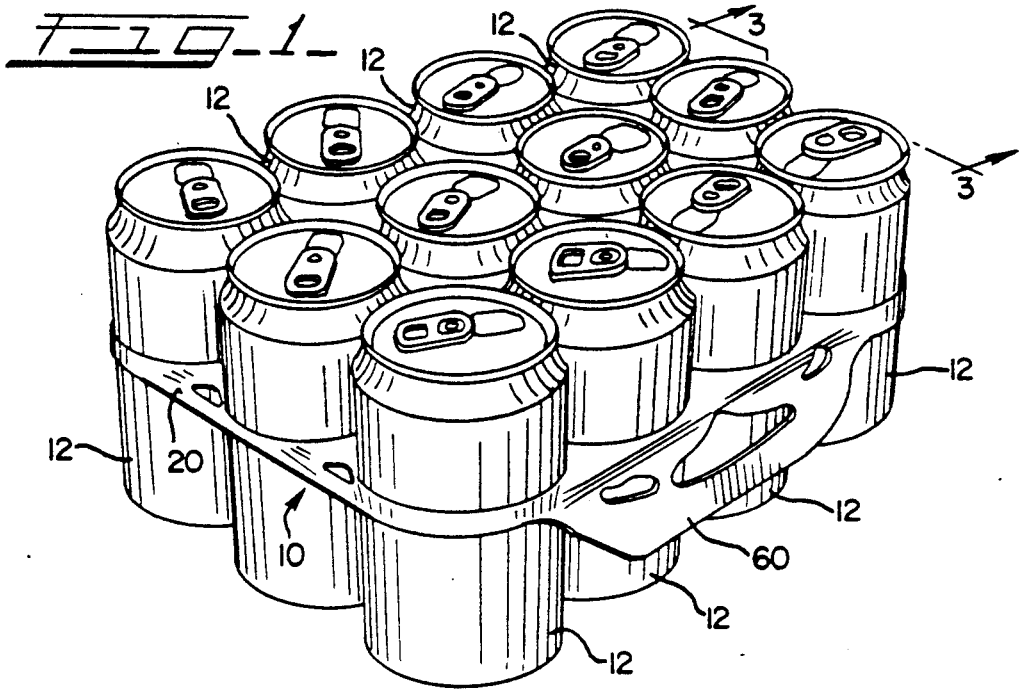
FIG. 1 is a perspective view of a package comprising twelve identical containers and a carrier severed from carrier stock according to a preferred embodiment of this invention.
Figure 2:
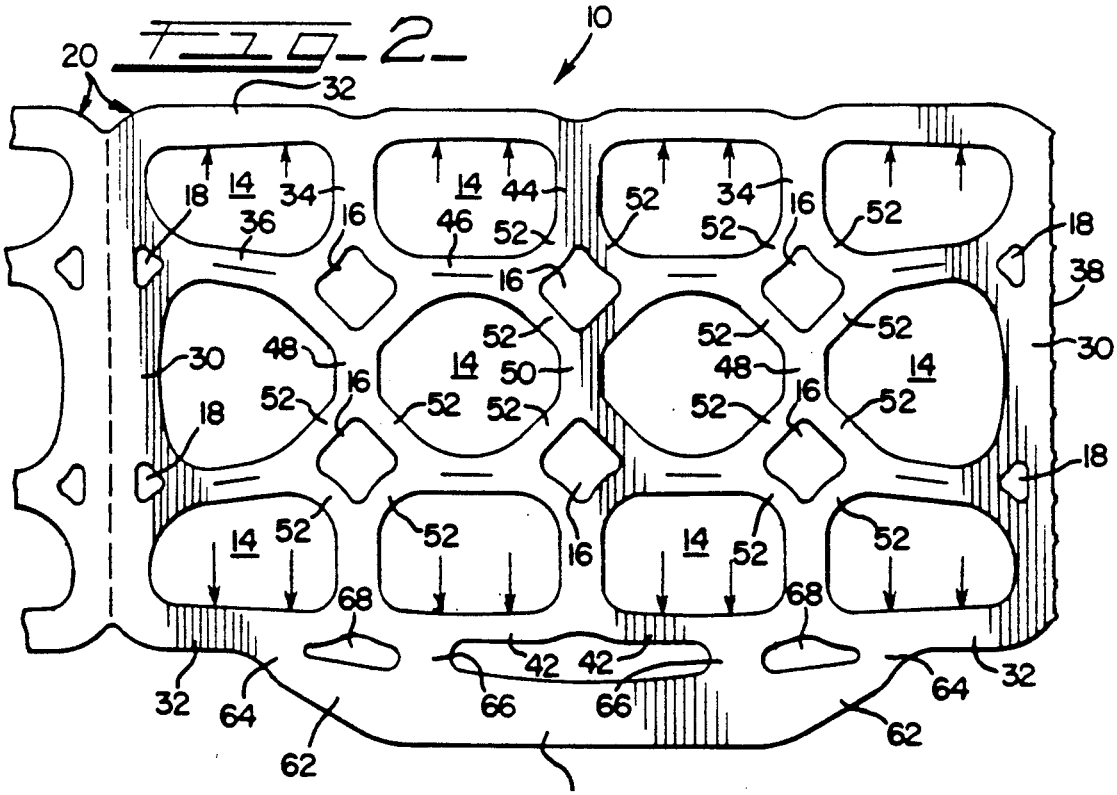
FIG. 2, on an enlarged scale, is a plan view of carrier stock according to the preferred embodiment of this invention.
Figure 3:
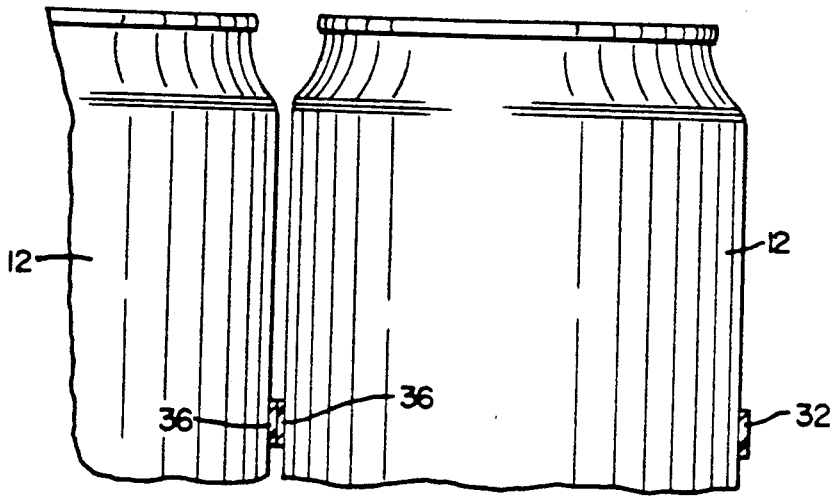
FIG. 3, on a further enlarged scale, is a fragmentary, sectional detail taken along line 3—3 of FIG. 1 in a direction indicated by arrows.

As shown in FIGS. 1 through 3, carrier stock 10 for machine application to substantially identical containers 12 constitutes a preferred embodiment of this invention. Such stock 10 is formed with separate apertures 14 to receive the individual containers 12. The carrier stock 10 is severable, along transverse lines to be later described, to form individual carriers 20 that are substantially identical.

As shown in FIG. 1, the containers 12 are beverage cans of a type used commonly for beer, soft drinks, and other beverages. This invention is not limited, however, to usage with such cans but is useful with cans, bottles, and other containers of various types.

In FIG. 1, a package is shown, which comprises twelve such containers 12 and one such carrier 20, as severed from such stock 10. One such carrier 20 is shown fully in FIG. 2, which also shows fragmentary portions of the next carrier 20. Each carrier 20 is shown in an unstressed condition in FIG. 2.

The carrier stock 10 is formed in an indeterminate length, as by die-cutting, from a single sheet of resilient polymeric material. A preferred material is low density polyethylene. A preferred thickness for such stock 10 in an unstressed condition, if low density polyethylene is used, is about 15.5 mils.

The carrier stock 10 is formed, for each individual carrier 20, with integrally joined band segments defining the separate apertures 14. As shown in FIG. 2, such apertures 14 are in a rectangular array with longitudinal rows and transverse ranks, namely three longitudinal rows and four transverse ranks for each individual carrier 20. Each aperture 14 has a distinctive contour, as shown, with rounded corners to avoid stress concentrations.

Specifically, the apertures 14 are in two edge rows and one middle row between the edge rows. For each individual carrier 20, the apertures 14 are in two end ranks and two middle ranks between the end ranks. As compared to the apertures 14 in the middle row, the apertures 14 in the edge rows are contoured differently. The apertures 14 in each end rank are contoured as mirror images of the apertures 14 in the other end rank. The apertures 14 in each edge row are contoured as mirror images of the apertures 14 in the other edge row.

The carrier stock 10 is applied to the respective containers 12 as the carrier stock disclosed in Klygis U.S. Pat. No. 4,018,331 is applied. A suitable machine for applying such stock 10 is disclosed in Benno et al. U.S. Pat. No. 3,959,949.

A preferred machine for applying the carrier stock 10 is disclosed in a co-pending application filed simultaneously herewith, by Lonnie Ray Seymour and Kevin Dewain Moore, under U.S. Ser. No. 07,519,860 and assigned commonly herewith, for "Apparatus and Method for Applying Multi-Package Device."

The container-receiving aperture 14 of each end rank at each edge row, i.e., the container-receiving aperture 14 at each corner of each individual carrier 20, has a generally quadrilateral contour. Each such aperture 14 is defined by band segments including an outer cross segment 30, an outer edge segment 32, an inner cross segment 34, and an inner oblique segment 36. Each outer cross segment 30 extends completely across the carrier stock 10, between the opposite edges of such stock 10, and is shared by the three apertures 14 of one of the end ranks. The quadrilateral contour of the apertures creates a stress in the finished package that contributes to the overall stability and rigidity of the package.

Also, each outer cross segment 30 is panel-like and is shared by two successive carriers 20, until the successive carriers 20 are severed from the carrier stock 10. Each outer cross segment 30 is formed with a perforated (weakened) line 38, which divides such outer cross segment 30 into half segments of approximately equal width. Such line 38 facilitates severance of such stock 10 to form the individual carriers 20.

The container-receiving aperture 14 of each middle rank at each edge row has a generally rectangular contour. Each such aperture 14 is defined by band segments including one of the inner cross segments 34, an outer edge segment 42, an inner cross segment 44, and an inner longitudinal segment 46. Each of the inner cross segments 34 is shared by two of the apertures 14 at each edge row. The inner cross segment 44 is shared by the apertures 14 of both middle ranks at each edge row.

The contour-receiving apertures 14 of each end rank at the middle row has an arbitrary contour. Each such aperture 14 is defined by band segments including one of the outer cross segments 30, both of the inner oblique segments 36, a diagonal segment 52, and an inner cross segment 48. Each aperture 14 of the middle ranks at the middle row has a generally lemon-shaped contour with truncated ends, as shown, and is defined by one of the inner cross segments 48, both of the inner longitudinal segments 46, and an inner cross segment 50.

Each aperture 16 has a generally rhomboid contour, as shown, with rounded corners to avoid stress concentrations. Each such aperture 16 is defined by four diagonal segments 52 comprising the margin of such aperture 16.

Each of the inner cross segments 34 is joined to certain of the segments 52 comprising the margin of one of the additional apertures 16. Also, one of the inner oblique segments 36, one of the inner longitudinal segments 46, and one of the inner cross segments 48 are joined respectively to certain of the same segments 52 at the same aperture 16.

Each inner oblique segment 36 is bifurcated at one end, as shown, where it joins one of the outer cross segments 30. The bifurcated ends of the inner oblique segments 36 and the outer cross segments 30 joined to such ends define the respective apertures 18. Such apertures 18 are generally triangular, as shown, with rounded corners to avoid stress concentrations.

When the carrier stock 10 is unstressed, each of the outer cross segments 30 extends in a generally transverse direction. Also, each of the outer edge segments 32, 42, extends in a generally longitudinal direction. Moreover, each of the inner cross segments 34, 44, 48, 50, extends in a generally transverse direction. However, each inner oblique segment 36 extends from one of the outer cross segments 30, namely the outer cross segment 30 to which such inner oblique segment 36 is joined, in a generally oblique direction tending away from the outer edge segment 32 joined to the same one of the outer cross segments 30.

When the carrier stock 10 is applied by a machine (not shown) like the machine disclosed in Benno et al. U.S. Pat. No. 3,959,949 or by a machine like the machine disclosed in the co-pending application noted above to containers like the containers 12, transverse forces are applied to the outer edge segments 32, 42, as suggested by arrows in FIG. 2. Such forces tend to stretch the inner cross segments 34, 44, 48, 50. Also, such forces tend to reconfigure such stock 10 from an as-formed configuration, in which such stock 10 is shown in FIG. 2, to an application configuration, in which such stock 10 is applied to containers exemplified by the containers 12. Diagonal segments 52 operate to transfer the forces in a manner designed to open each aperture 14 into a generally circular form. This phenomenon is described in the '331 patent.

The apertures 16 are configured, oriented, and located in such manner that the apertures 16 tend to be transversely elongated, as the band segments 52 comprising their margins and the band segments 34, 44, 48, 50, joined to the band segments 52 are stretched, when transverse forces are applied to the band segments 32, 42, as mentioned above. The apertures 16 function, therefore, to facilitate reconfiguration of the carrier stock 10 from the as-formed configuration to the application configuration. Since a diagonal segment 52 does not exist at the outer region of the end ranks, the apertures 18 do not tend to be similarly elongated and do not contribute significantly to reconfiguration of stock 10 (more particularly to reconfiguration of each rank apertures 14) due to stretch-inhibiting characteristics of end panels 30.

When transverse forces are applied to the band segments 32, 42, as mentioned above, the carrier stock 10 is reconfigured from the as-formed configuration to the application configuration, and the oblique segments 36 and the longitudinal segments 46 tend to be longitudinally aligned with one another. Thus, each container-receiving aperture 14 tends to assume a nearly circular contour, which is slightly smaller than one of the containers 12. Stretching of the band segments to enable each such aperture 14 to assume a nearly circular contour adds to the tightness of the package that is created when the carrier stock 10 is applied to the respective containers 12.

The overall length of each individual carrier 20, when the carrier stock 10 is unstressed, is slightly greater than the overall length of the individual carrier 20 in a package, such as the package shown in FIG. 1. However, the combined, longitudinal measurements of the four apertures 14 in each longitudinal row of each individual carrier 20, when the carrier stock 10 is unstressed, is less than the combined, longitudinal measurements of the four apertures 14 in each longitudinal row of the individual carrier 20 in the package.

Thus, the carrier stock 10 has a nonuniform or short pitch, which requires the band segments defining the respective apertures 14 to be longitudinally stretched when the carrier stock 10 is applied to such containers 12 to create a package, such as the package shown in FIG. 1. Moreover, because the carrier stock 10 has the nonuniform or short pitch noted above and because the outer cross segments 30 are panel-like (until the successive carriers 20 are severed from such stock 10) and do not contribute significantly to reconfiguration of the such stock 10, the package tends to be quite tight.

Moreover, when the carrier stock 10 is applied to the respective containers 12, the band segments 36, 46, tend to fold along folding lines defined where such segments 36, 46, are slit, as shown in FIG. 3. Where such segments 36, 46, are shown as slit to define folding lines, such segments 36, 46, may be alternatively scored or provided with other weakened lines or line segments. The band segments 34, 44, 48, 50 tend to fold similarly. The folding lines defined along the band segments 36, 46, and the folding lines defined along the band segments 34, 44, 48, 50, facilitate application of such stock 10 to containers like the containers 12.

If the band segments 36, 46, were not slit to define folding lines, each of such segments 36, 46 would tend not to fold but to conform to one such container 12, but not to the next container 12 in the same rank. By being slit to define folding lines, the band segments 36, 46, permit pairs of adjacent containers 12 in each rank to have independent, container-conforming bands.

Furthermore, for each individual carrier 20, the carrier stock 10 is formed with an integral handle 60 at what may be hereinafter called the handle edge of such stock 10. Each handle 10 has two ends 62, each of which is bifurcated to form an outer foot 64 and an inner foot 66. The outer foot 64 of each end 62 is joined to one of the outer edge segments 32 at the handle edge of such stock 10, between one of the cross segments 34 and one of the cross segments 30. The inner foot 66 of such end 62 is joined to the outer edge segment 42 adjoining the same one of the outer edge segments 32, between the same one of the cross segments 34 and one of the cross segments 44.

At each end 62 of each handle 60, the outer foot 64, the inner foot 66, and the adjoining segments 32, 42, define an ancillary aperture 68. Each ancillary aperture 68 is generally triangular, as shown, with rounded corners to avoid stress concentrations.

Thus, stresses from each end 62 of the handle 60 are distributed to multiple band segments including the adjoining segments 32, 42, and the cross segments 30, 34, and 32 joined to the adjoining segments 32, 42.

Preferably, the carrier stock 10 has an asymmetrical configuration, as disclosed in Olsen et al. U.S. Pat. No. 4,356,914.

Figure 4:
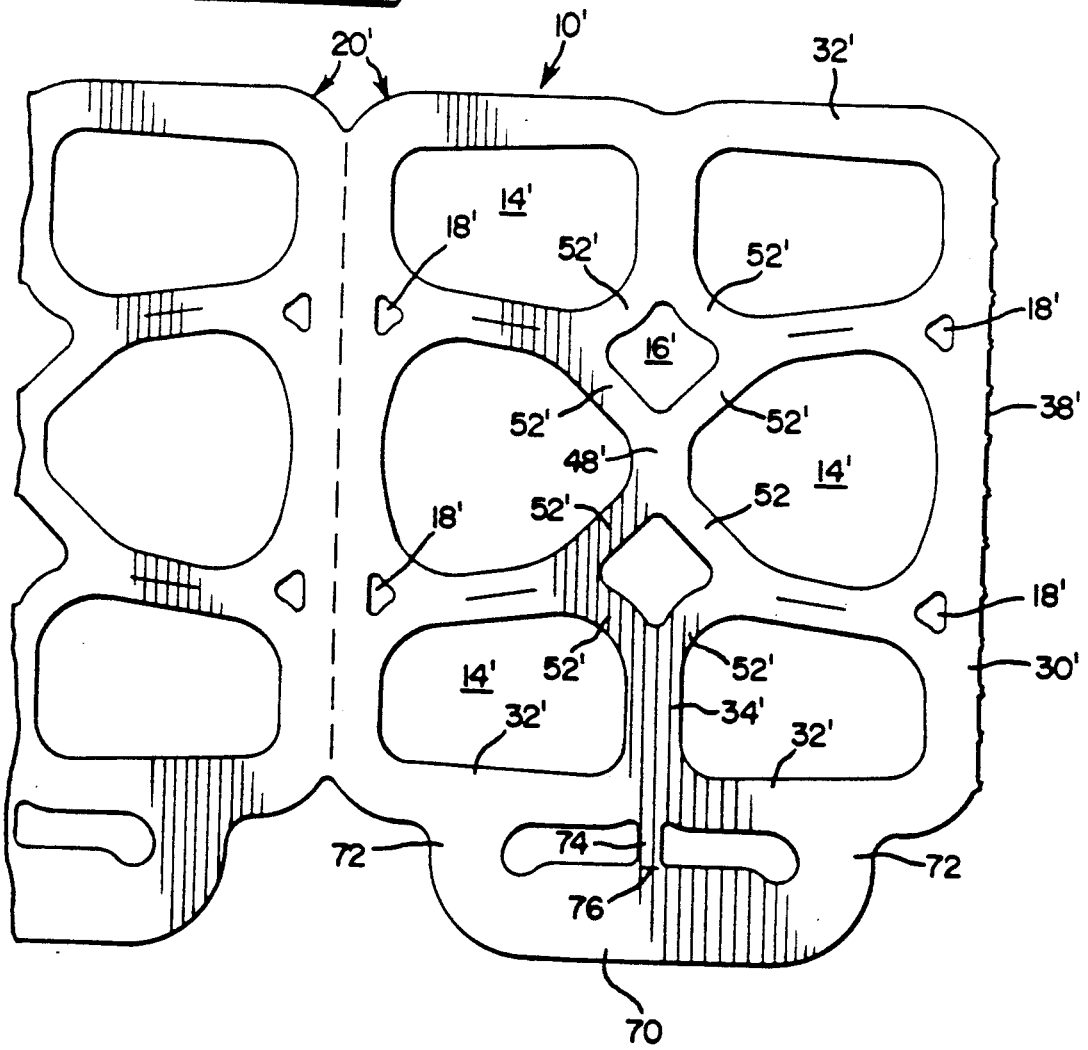
FIG. 4, on a slightly enlarged scale compared to FIG. 2, is a plan view of carrier stock according to an alternate embodiment of this invention.

Carrier stock 10' constituting an alternate embodiment of this invention is shown in FIG. 4, in which primed reference numbers are used to designate elements corresponding for purposes of this invention to elements designated by those reference numbers (unprimed) in FIGS. 1, 2, and 3.

The carrier stock 10' is severable, generally as the carrier stock 10 is severable, into individual carriers 20'. The carrier stock 10' is formed, for each individual carrier 20', with integrally joined band segments defining six container-receiving apertures 14' two additional apertures 16', and four additional apertures 18'.

Broadly, except as illustrated and described herein, the carrier stock 10' is similar to the carrier stock 10 except that the carrier stock 10' does not have any apertures corresponding to the apertures 14 of the middle ranks of the carrier stock 10 or to the apertures 16 between the band segments 44 of such stock 10 and the band segment 50 thereof. The carrier stock 10' has a handle 70 differing in some details from the handle 60 of the carrier stock 10. The carrier stock 10' has features described below.

Thus, for each individual carrier 20', the carrier stock 10' has two outer cross segments 30', two outer edge segments 32' along the handle edge of such stock 10', two outer edge segments 32' along the opposite edge of such stock 10', two inner cross segments 34', and one inner cross segment 48'. Also, each of the inner cross segments 34' is separated from the inner cross segments 48' by the band segments 52' comprising the margin of one of two additional apertures 16'.

The carrier stock 10' is similar to carrier stock disclosed in a co-pending application filed simultaneously herewith, by Leslie S. Marco and Robert Olsen, under U.S. application Ser. No. 07/519,858, and assigned commonly herewith, for "Carrier Stock With Integral Handles." Specific details of the carrier stock 10', beyond those details disclosed herein, may be found by reference to the co-pending application noted in the preceding sentence.

The handle 70 has two ends 72, which are not bifurcated, and a middle leg 74. The middle leg 74 is joined where two outer edge segments 32' are joined to one inner cross segment 34' at the handle edge of the carrier stock 10' via a perforated line 76 defining a break-away joint. The break-away joint enables the middle leg 74 to be easily broken away from other portions of the handle 70.

Each end 72 of the handle 70 is joined to one of the outer edge segments 32' at the handle edge of the carrier stock 10'. Thus, stresses from the handle 70 are distributed to the inner cross segment 34' as well as to the outer cross segments 30', via the outer edge segments 32'.

Each outer cross segment 30' has a perforated (weakened) line 38' dividing such outer cross segment 30' into half segments. Such lines 38' facilitate severance of the carrier stock 10' transversely to form the individual carriers 20'.

Various modifications may be made in the carrier stock 10, or in the carrier stock 10', without departing from the scope and spirit of this invention.

We claim:

1. Carrier stock for machine application to substantially identical containers, said stock being formed from a single sheet of resilient polymeric material, said stock having opposite edges and being severable to form individual carriers with opposite ends, with separate container-receiving apertures to receive the individual containers, and with at least one additional aperture, which facilitates reconfiguration of said stock from an as-formed configuration to an application configuration, said stock being formed with band segments defining the container-receiving and additional apertures, each container-receiving or additional aperture having a margin comprising certain of said segments, the container-receiving apertures for each individual carrier being in longitudinal rows including edge rows at the opposite edges of said stock and in transverse ranks including end ranks at the opposite ends of each such individual carrier, the container-receiving aperture at each end rank of each edge row being defined by certain of said segments including (a) an outer cross segment, along which said stock is severable, the outer cross segment extending completely across said stock in the form of a continuous panel, between the opposite edges of said stock, and extending in a generally transverse direction when said stock is unstressed, (b) an outer edge segment extending along one of the opposite edges of said stock and extending in a generally longitudinal direction when said stock is unstressed, (c) an inner cross segment extending from the outer edge segment to the margin of one of the additional apertures and extending in a generally transverse direction when said stock is unstressed, and (d) an inner oblique segment extending from the outer cross segment to the margin of the same one of the additional apertures and extending in a generally oblique direction tending away from the outer edge segment when said stock is unstressed.

2. The carrier stock of claim 1 wherein the inner oblique segment is slit to define a folding line extending in the generally oblique direction when said stock is unstressed.

3. The carrier stock of claim 2 wherein each transverse row has more than two of the container-receiving apertures; wherein, except for the container-receiving apertures in the end ranks, each container-receiving aperture in each edge row is defined partly by one of said segments, said one of said segments extending in a generally longitudinal direction when said stock is unstressed; and wherein the same one of said segments defines a folding line extending in a generally longitudinal direction when said stock is unstressed.

4. The carrier stock of claim 1 wherein said stock is formed for each individual carrier with an integral handle having opposite ends and being joined at the opposite ends of the handle, at one edge of said stock, to certain of the band segments.

5. The carrier stock of claim 1 wherein each end of the handle is joined to one of the outer edge segments.

6. The carrier stock of claim 5 wherein each end of the handle is joined also to an adjoining one of the band segments.

7. The carrier stock of claim 6 wherein each end of the handle is bifurcated to form two feet, namely one foot joined to said one of the outer edge segments and another foot joined to the adjoining one of the band segments.

8. The carrier stock of claim 7 wherein, at each end of the integral handle, one foot formed at such end is joined to said one of the outer edge segments, between one of the cross segments and another of the cross segments, and another foot formed at such end is joined to an adjoining one of the outer edge segments, between said one of the cross segments and another of the cross segments.

9. The carrier stock of claim 1 wherein the outer cross segment is formed with a weakened line facilitating severance of said stock to form the individual carriers.

10. The carrier stock of claim 9 wherein the weakened line is perforated.

11. The carrier stock of claim 4 combined with a rectangular array of such containers, each container having a side wall, at which such container is gripped by the band segments comprising the margin of one of the container-receiving apertures.

12. A package comprising twelve substantially identical containers in a rectangular array with three longitudinal rows and four transverse ranks, each container having a side wall, and a carrier applied to said containers so as to grip said containers at the side walls of said containers, said carrier being severed from carrier stock formed from a single sheet of resilient polymeric material, said stock having opposite edges and being severable to form individual carriers including said carrier with opposite ends, with separate container-receiving apertures to receive the individual containers, and with at least one additional aperture, which facilitates reconfiguration of said stock from an as-formed configuration to an application configuration, said stock being formed with band segments defining the container-receiving and additional apertures, each container-receiving or additional aperture having a margin comprising certain of said segments, the container-receiving apertures for each individual carrier being in three longitudinal rows including edge rows at the opposite edges of said stock and in four transverse ranks including end ranks at the opposite ends of each such individual carrier, the container-receiving aperture at each end rank of each edge row being defined by certain of said segments including (a) an outer cross segment, along which said stock is severable, the outer cross segment extending completely across said stock in the form of a continuous panel, between the opposite edges of said stock, and extending in a generally transverse direction when said stock is unstressed, (b) an outer edge segment extending along one of the opposite edges of said stock and extending in a generally longitudinal direction when said stock is unstressed, (c) an inner cross segment extending from the outer edge segment to the margin of one of the additional apertures and extending in a generally transverse direction when said stock is unstressed, and (d) an inner oblique segment extending from the outer cross segment to the margin of the same one of the additional apertures and extending in a generally oblique direction tending away from the outer edge segment when said stock is unstressed.

13. Carrier stock for machine application to substantially identical containers, said stock being formed from a single sheet of resilient polymeric material, said stock having opposite edges and being severable to form individual carriers with opposite edges and with apertures including separate container-receiving apertures to receive the individual containers, said stock being formed with band segments defining said apertures, said segments including edge segments extending along the opposite edges of said stock and extending in a generally longitudinal direction when said stock is unstressed, said segments including cross segments extending from the edge segments and extending in a generally transverse direction when said stock is unstressed, said stock being formed for each individual carrier, with an integral handle having opposite ends, each of which is joined to one of the edge segments and also to an adjoining one of the band segments.

14. The carrier stock of claim 13 wherein each end of the integral handle is bifurcated so as to form two feet, namely one foot joined to said one of the edge segments and another foot joined to the adjoining one of the band segments.

15. The carrier stock of claim 14 wherein, at each end of the integral handle, one foot formed at said end is joined to said one of the edge segments, between one of the cross segments and another of the cross segments, and another foot formed at such end is joined to an adjoining one of said edge segments, between said one of the cross segments and another of the cross segments.

16. Carrier stock for machine application to substantially identical containers, each having a side wall, said stock being formed from a single sheet of resilient polymeric material, said stock having opposite edges and being severable to form individual carriers with separate container-receiving apertures to receive the individual containers and with at least one additional aperture which facilitates reconfiguration of said stock from an as-formed configuration to an application configuration, to which said stock is reconfigured when applied to such containers so as to grip such containers at the side walls of such containers, said stock being formed with band segments defining the container-receiving and additional apertures, the container-receiving apertures for each individual carrier being in longitudinal rows including edge rows at the opposite edges of said stock and in transverse ranks, the container-receiving apertures in each edge row being generally quadrilateral in the as-formed configuration of said stock, said stock being formed in such manner that said stock has an overall length that is greater in the as-formed configuration than in the application configuration, in such manner that the container-receiving apertures in each longitudinal row have combined longitudinal measurements that are less when said stock is unstressed than when said stock is applied to such containers so as to grip such containers at the side walls of such containers, and in such manner that the band segments defining the container-receiving apertures must be longitudinally stretched for said stock to be so applied and to be thus reconfigured from the as-formed configuration to the application configuration. defining the container-receiving apertures must be longitudinally stretched for said stock to be so applied.

17. The carrier stock of claim 16 wherein said stock is formed for each individual carrier with an integral handle having opposite ends and being joined at the opposite ends of the handle, at one edge of said stock, to certain of the band segments.

18. The carrier stock of claim 17 wherein the opposite ends of the handle are joined to certain of the band segments defining certain of the container-receiving apertures in one of the edge rows.

19. The carrier stock of claim 16 wherein the transverse ranks include end ranks for each individual carrier, wherein the container-receiving apertures in the end ranks of the edge rows are defined by outer cross segments, along which said stock is severable, by outer edge segments extending along the opposite edges of said stock, by inner segments extending from the outer edge segments, and by inner segments extending from the outer cross segments, and wherein the inner segments extending from the outer cross segments are slit to define folding lines extending along the slit segments.

* * * * *

UNITED STATES PATENT AND TRADEMARK OFFICE

CERTIFICATE OF CORRECTION

PATENT NO. : 5,018,620

DATED : May 28, 1991

INVENTOR(S) : Leslie S. Marco, Mindaugas J. Klygis and William N. Weaver

It is certified that error appears in the above-identified patent and that said Letters Patent is hereby corrected as shown below:

Title Page:

In the ABSTRACT, end of line 11, the last occurrence of "at each end rank" should be deleted.

Column 4, line 7, in the Serial No., between "7" and "5" delete the "," and insert a --/-- .

Column 5, line 33, --a-- should be inserted after "such".

Column 5, line 44, --such-- should be inserted after "of".

Column 10, line 34, --i-- should be inserted between the "t" and "o" to correct "tion".

Column 10, lines 44, 45, and 46, delete unnecessary text "defining the container-receiving apertures must be longitudinally stretched for said stock to be so applied".

Signed and Sealed this

Second Day of March, 1993

*Attest:*

STEPHEN G. KUNIN

*Attesting Officer*

*Acting Commissioner of Patents and Trademarks*